US006894647B2

(12) United States Patent
Jenwatanavet

(10) Patent No.: US 6,894,647 B2
(45) Date of Patent: May 17, 2005

(54) INVERTED-F ANTENNA

(75) Inventor: Jay Jenwatanavet, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/445,107

(22) Filed: May 23, 2003

(65) Prior Publication Data

US 2004/0056808 A1 Mar. 25, 2004

Related U.S. Application Data

(63) Continuation-in-part of application No. 10/120,603, filed on Apr. 9, 2002, now abandoned.

(51) Int. Cl.[7] ..... H01Q 1/38
(52) U.S. Cl. ..... 343/700 MS; 343/702
(58) Field of Search ..... 343/700 MS, 702, 343/846, 850

(56) References Cited

U.S. PATENT DOCUMENTS 6,404,395 B1 * 6/2002 Masuda ..... 343/702
6,611,235 B2 * 8/2003 Barna et al. ..... 343/702
6,639,560 B1 * 10/2003 Kadambi et al. .... 343/700 MS
2004/0066334 A1 * 4/2004 Fang et al. ..... 343/700 MS
2004/0113848 A1 * 6/2004 Gaucher et al. ..... 343/702

* cited by examiner

*Primary Examiner*—Hoang V. Nguyen

(57) ABSTRACT

A coupled-feed inverted-F antenna is provided comprising a transmission line port, an open radiator with an unterminated end, a shorted "L" shaped radiator connected to the open radiator with a terminated end, a coupled-feed connected between the transmission line port signal interface and the open and shorted radiators, and a groundplane. The coupled-feed is oriented parallel to the open radiator. A coplanar inverted-F antenna is provided comprising a transmission line port, an open radiator oriented in a first plane, a shorted "L" shaped radiator oriented in the first plane connected to the open radiator and having an terminated end, a feed oriented in the first plane and connected between the transmission line port signal interface and the radiators, and a groundplane oriented in the first plane. The shorted radiator is terminated in the transmission line port ground interface. The antenna may also employ both coplanar and coupled-feed features.

25 Claims, 4 Drawing Sheets

INVERTED-F ANTENNA

RELATED APPLICATIONS

This application is related to application Ser. No. 10/120,603, entitled, INVERTED-F FERROELECTRIC ANTENNA, invented by Jorge Fabrega-Sanchez, Stanley S. Toncich and Alan Tran, filed Apr. 9, 2002, now abandoned, which is hereby incorporated by reference.

BACKGROUND OF THE INVENTION

1. Field of the Invention

This invention generally relates to wireless communication antennas and, more particularly, to an improved inverted-F antenna including coplanar and coupled-feed features.

2. Description of the Related Art

Many conventional wireless communications devices, such as a wireless telephone, uses a whip antenna. The whip propagates excellently, when deployed (extended) from the device chassis. However, the antenna can have a fairly large form factor and, when seated in the chassis (contracted), performance is poor. A smaller, internally mounted, antenna is desirable. One such antenna is the so-called inverted-F antenna.

FIG. 1 is a depiction of a conventional planar inverted-F antenna (prior art). As noted in U.S. Pat. No. 6,317,083 (Johnson et al.), a planar inverted-F antenna (PIFA) may comprises a flat conductive sheet supported a height above a reference voltage plane, such as a groundplane. The sheet may be separated from the reference voltage plane by an air dielectric, or supported by a solid dielectric. A corner of the sheet is coupled to the ground via a grounding stub and provides an inductive load to the sheet. The sheet is designed to have an electrical length of $\lambda/4$ at the desired operating frequency. A feed is coupled to an edge of the flat sheet adjacent the grounded corner. The feed may comprise the inner conductor of a coaxial line. The outer conductor of the coaxial line terminates on and is coupled to the ground plane. The inner conductor extends through the ground plane, through the dielectric (if present) and to the radiating sheet. As such, the feed is shielded by the outer conductor as far as the groundplane but then extends, unshielded, to the radiating sheet.

The PIFA forms a resonant circuit having a capacitance and inductance per unit length. The feed point is positioned on the sheet a distance from the corner such that the impedance of the antenna at that point matches the output impedance of the feed line, which is typically 50 ohms. The main mode of resonance for the PIFA is between the short circuit and the open circuit edge. Thus, the resonant frequency supported by the PIFA is dependent on the length of the sides of the sheet and to a lesser extent the distance and the thickness of the sheet.

Planar inverted-F antennas have found particular applications in portable radio devices, e.g. radio telephones, personal organizers, and laptop computers. Their high gain and omni-directional radiation patterns are particularly suitable. Planar antennas are also suitable for applications where good frequency selectivity is required. Additionally, since the antennas are relatively small at radio frequencies, the antennas can be incorporated into the housing of a device, thereby not distracting from the overall aesthetic appearance of the device. In addition, placing the antenna inside the housing means that the antenna is less likely to be damaged.

However it is difficult to design a planar antenna that offers performance comparable to that of a whip antenna, in particular as far as the bandwidth characteristics of the device are concerned. Loss in an antenna is generally due to two sources: radiation, which is required; and energy that is conducted away from the antenna, which is undesirable. Planar antennas have an undesirably low impedance bandwidth.

It would be advantageous if the conventional inverted-F antenna could be improved to reduce its form factor and enhance its gain.

It would be advantageous if an inverted-F antenna could operate with another antenna in a non-interfering manner, while sharing a common ground plane.

SUMMARY OF THE INVENTION

The present invention describes an improved inverted-F antenna. In particular, a coplanar PIFA (CPIFA) and a coupled-feed PIFA are presented. The CPIFA has a reduced form factor, as it can be fabricated on a single sheet. Further, the coplanar aspect of the groundplane permits the CPIFA to be orthogonal to a second antenna, while sharing the same groundplane, to minimize mutual interference. The coupled-feed PIFA permits a PIFA antenna to be connected to a transceiver using a conventional coaxial type connector. The coplanar and coupled-feed aspects can also be combined.

Accordingly, a coupled-feed inverted-F antenna is provided comprising a transmission line port, an open radiator with an unterminated end, a shorted "L" shaped radiator connected to the open radiator and having a terminated end. The antenna further comprises a coupled-feed, connected between the transmission line port signal interface and the open and shorted radiators, and a groundplane. The shorted radiator is terminated in the transmission line port ground interface.

The coupled-feed includes a section oriented parallel to the open radiator. For this reason, the feed is considered to be coupled to the radiator and/or the groundplane.

A coplanar inverted-F antenna is also provided comprising a transmission line port, an open radiator oriented in a first plane having an unterminated end, a shorted "L" shaped radiator oriented in the first plane, connected to the open radiator, and having an terminated end. The coplanar antenna includes a feed oriented in the first plane and connected between the transmission line port signal interface and the open and shorted radiators. A groundplane is also oriented in the first plane. The shorted radiator is terminated in the transmission line port ground interface.

Additional details of the two above-described antennas, as well as antenna systems that benefit from the above-mentioned antennas, are provided below.

DETAILED DESCRIPTION OF THE PREFERRED EMBODIMENTS

Figure 1:
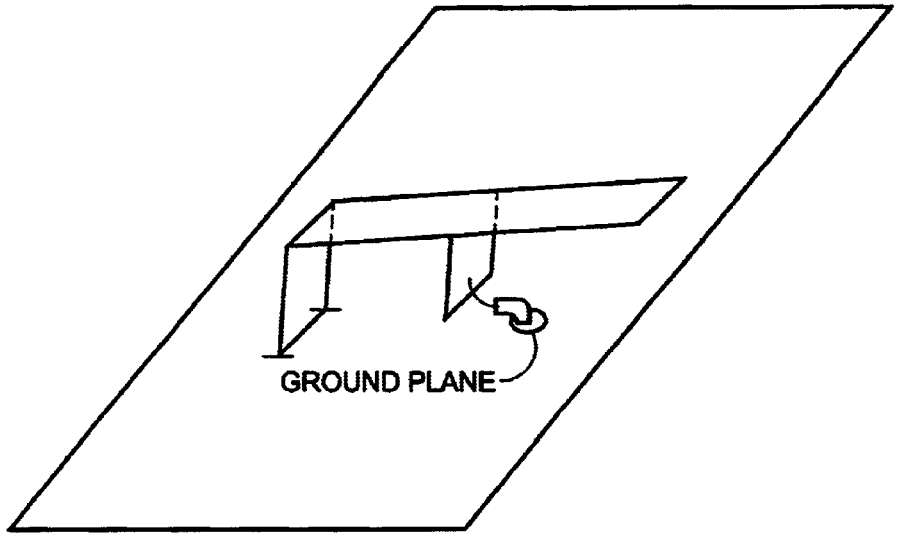
FIG. 1 (PRIOR ART)
FIG. 1 is a depiction of a conventional planar inverted-F antenna (prior art).
Figure 2:
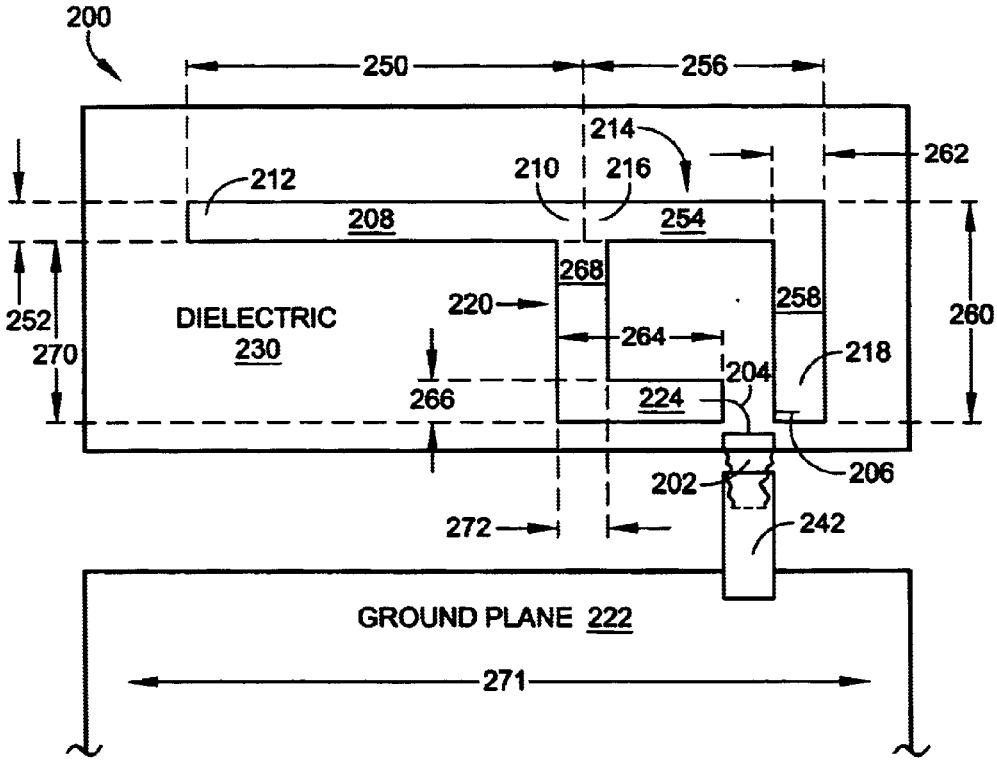
FIG. 2 is a plan view depicting the present invention coupled-feed inverted-F antenna.

FIG. 2 is a plan view depicting the present invention coupled-feed inverted-F antenna. The coupled-feed PIFA 200 comprises a transmission line port 202 including a signal interface 204 and a ground interface 206. Conventionally, the impedance relationship between the signal interface 204 and the ground interface is 50 ohms, however, other impedances are possible. An open radiator 208 has a first end 210 and a second, unterminated end 212. A shorted "L" shaped radiator 214 has a first end 216, connected to the open radiator first end 210, and a second, terminated end 218. A coupled-feed 220 is connected between the transmission line port signal interface 204, and the open radiator first end 210 and the shorted radiator first end 216. That is, the coupled-feed 220 meets the radiator at the junction between the open radiator first end 210 and shorted radiator first end 216.

The coupled-feed antenna 200 also includes a groundplane. FIG. 2 depicts a groundplane 222 that is coplanar with the open radiator 208 and the shorted radiator 214. However, the groundplane need not necessarily be coplanar. In fact, a planar (multi-plane) coupled-feed PIFA is described below in FIG. 5. The shorted radiator 214 is terminated in the transmission line port ground interface 206. The transmission line port ground interface 206 is either directly connected to the groundplane 222 through a mating connector, or operatively connected to the groundplane 222 through electrical components (not shown) intervening between the groundplane 222 and the ground interface 206.

In some aspects, the coupled-feed 220 includes a first section 224 oriented parallel to the open radiator 208 and a section of the shorted radiator 214. The parallel orientation of the coupled-feed first section 224, with the open radiator 208, permits coupling. Depending on spacing from the groundplane 222, the first section 224 may couple with the groundplane. More specifically, the coupled-feed 220 can be said to have an "L" shape. Note that the antenna dimensions and parameters are designed to account for this coupling effect. Also note that the coupled-feed 220 need not necessarily include a parallel (to the radiator 208) section. This is just one example of fairly direct coupling.

Figure 3A:
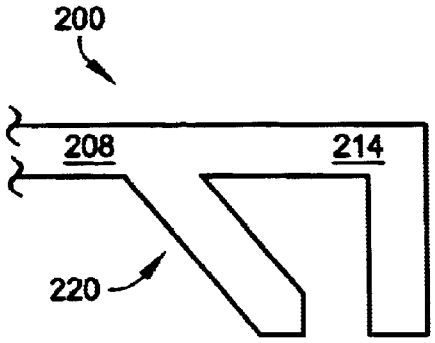
FIGS. 3*a* through 3*c* illustrate some exemplarily alternatives to the "L" shaped or parallel section coupled-feed of FIG. 2.
Figure 3B:
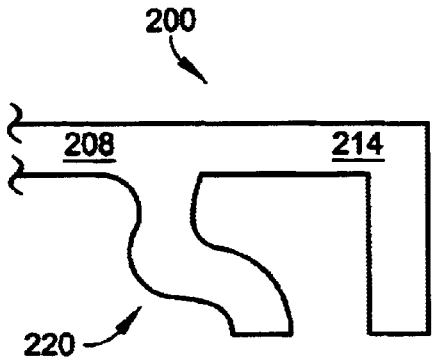
Figure 3C:
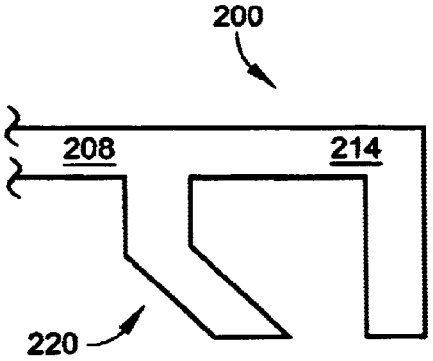

FIGS. 3*a* through 3*c* illustrate some exemplarily alternatives to the "L" shaped or parallel section coupled-feed of FIG. 2. The designs depicted in FIGS. 3*a* through 3*c* feature feeds that are differently coupled to the radiators 208 and 214, and the groundplane 222, as compared to the coupled-feed 220 of FIG. 2.

Returning to FIG. 2 it can be seen that the open radiator 208 is formed as a conductive layer in a first plane overlying a dielectric 230. A variety of microstrip design circuit boards are known in the art that include a dielectric, such as ceramic or FR-4, with overlying conductive traces of metal, such as one-ounce copper. The traces can be milled from an initially solid plane of copper, or deposited. Any of these board types are suitable, or could enable the antenna 200 (or any of the other antennas presented below). The shorted radiator 214 and coupled-feed 220 are also formed as a conductive layer in the first plane overlying the dielectric 230. As shown, the groundplane is also formed in the first plane.

In some aspects, the transmission line port 202 is a coaxial type connector including an inner signal conductor 204 and an outer ground conductor 206. There are many types of these coaxial type connectors known in the art, typically interfacing with an "opposite sex" connector. These connectors can be physically mated to each other with either a screw-on or snap-on connection. One such connector is the MMCX connector. However, almost any type of coaxial connector could be used. The coupled-feed first section 224 is connected to the coaxial connector inner signal conductor 204, and the shorted radiator second end 218 is connected to the coaxial connector outer ground conductor 206.

In some aspects, the groundplane is a transceiver module chassis oriented in the first plane and having an antenna port 242 connected to the transmission line port 202. As noted above, the antenna port 242 could be a coaxial connector, the opposite sex of the transmission line port 202. The transceiver module could be a wireless telephone and/or global positioning satellite (GPS)-transceiver module connected to a peripheral port of a personal computer (not shown). In other-aspects, the module chassis need not be a transceiver, but some other module passing wireless signals from a transceiver through a transmission line (not shown) that is, in turn, connected to the antenna port 242. For example, the antenna-connected module can be a cable modem interposed between the antenna and a transceiver, passing signals between the antenna and the transceiver. In other aspects, the antenna is connected directly to a computer interface port and the computer chassis acts as the groundplane. In this aspect the transceiver would be internal to the computer chassis.

To further illustrate the invention, a GPS version of the antenna 200 is presented. The antenna 200 radiates at a frequency in the range of 1565 to 1585 megahertz. In this variation the open radiator 208 has a length 250 of approximately 27 millimeters (mm), or less, and a width 252 of 1 mm, or less, overlying an FR4 dielectric 230 having a thickness of 0.81 mm (looking into the page). The length 250 is said to be approximate to compensate for variations in the definition of length. That is, the definition of length is made with respect to either the near edge, far edge, or center of the coupled-feed 220. The shorted radiator 214 has a first section 254 connected to the open radiator section first end 210 with a length 256 of approximately 10 mm, or less, and a width 252 of 1 mm, or less. Again, the length 256 is approximate in that the length can be measured from either the near edge, far edge, of center of the coupled-feed 220.

The shorted section 214 has a second section 258 perpendicular to the first section 254 having a length 260 of 8 mm, or less, and a width 262 of 1 mm, or less. The coupled-feed 220 has an "L" shape with the first section 224 having a length 264 of 8 mm, or less, and a width 266 of 1 mm, or less. The coupled-feed 220 has a second section 268 perpendicular to the first section 224, interposed between the first section 224 and the first ends 210/216 of the open and shorted radiators 208/214, respectively. The second section 268 has a length 270 of 7 mm, or less, and a width 272 of 1 mm, or less. In some aspects, the combined lengths 250 and 256 is approximately equal to or less than the width 271 of the groundplane 222. By approximate it is meant that the combined length of 250 and 256 is about 75 to 100% of the groundplane length 271. In some aspects, as shown, the groundplane length is 48 mm.

It should be appreciated that the coupled-feed antenna 200 makes possible the use of a simple connect/disconnect coaxial connector, while maintaining a small form factor, and making use of the interfacing module as a coplanar groundplane. Many compact inverted-F antennas are solder-connected to a transmission line, or connected to a PC board through a custom press-on connector, or clamped to the PC board by the chassis. For proper resonance, conventional inverted-F antennas are careful to maintain a separation between the feed and shorted radiator section. The present invention coupled-F antenna is designed so that at least a portion of the feed can be brought within close proximity of the shorted radiator section. This close proximity permits a coaxial connection be made to the feed and shorted radiator section. As a result of the coaxial connection, the antenna 200 can be simply engaged or disengaged from a transceiver. In this manner, the antenna 200 benefits portable operations.

Figure 4:
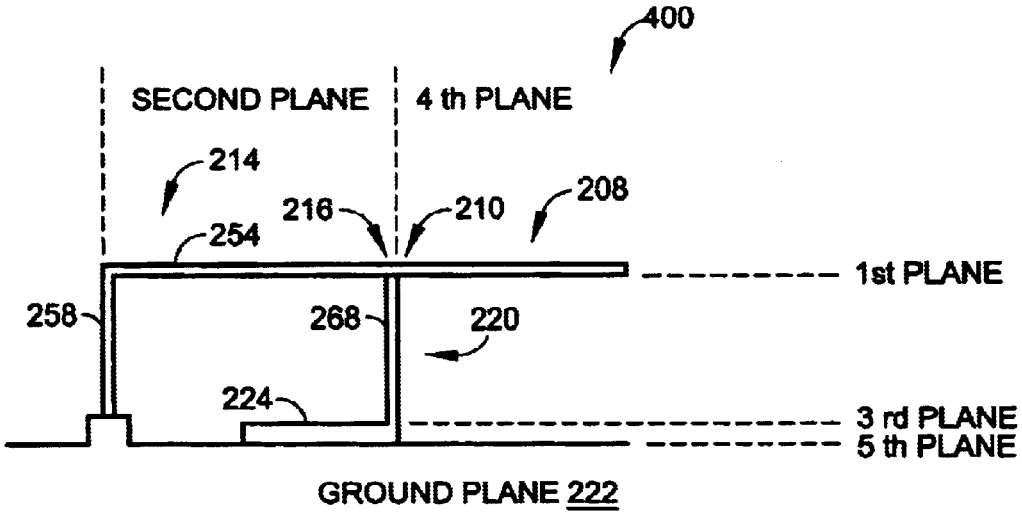
FIG. 4 is a partial cross-sectional view of a planar version of the coupled-feed inverted-F antenna.

FIG. 4 is a partial cross-sectional view of a planar version of the coupled-feed inverted-F antenna 400. Like the antenna of FIG. 2, a coupled-feed is used. Unlike the antenna of FIG. 2, the antenna elements are formed in different planes. The open radiator 208 is a conductor formed in a first plane. The shorted radiator 214 includes a first section 254 conductor formed in the first plane and a second section conductor 258 formed in a second plane perpendicular to the first plane. The coupled-feed 220 includes a first section 224 conductor formed in a third plane underlying and parallel to the first plane, and a second section conductor 268 formed in a fourth plane parallel to the second plane, interposed between the coupled-feed first section 224 and the open and shorted radiator first ends 210/216. The groundplane 222 is formed in a fifth plane underlying and parallel to the third plane. In this variation, the coupled-feed first section 224 can be a trace on a printed wiring board (PWB) overlying a groundplane or a dielectric. Note that although an "L" shaped coupled-feed 220 is shown, the invention is not limited to any particular shape.

Figure 5A:
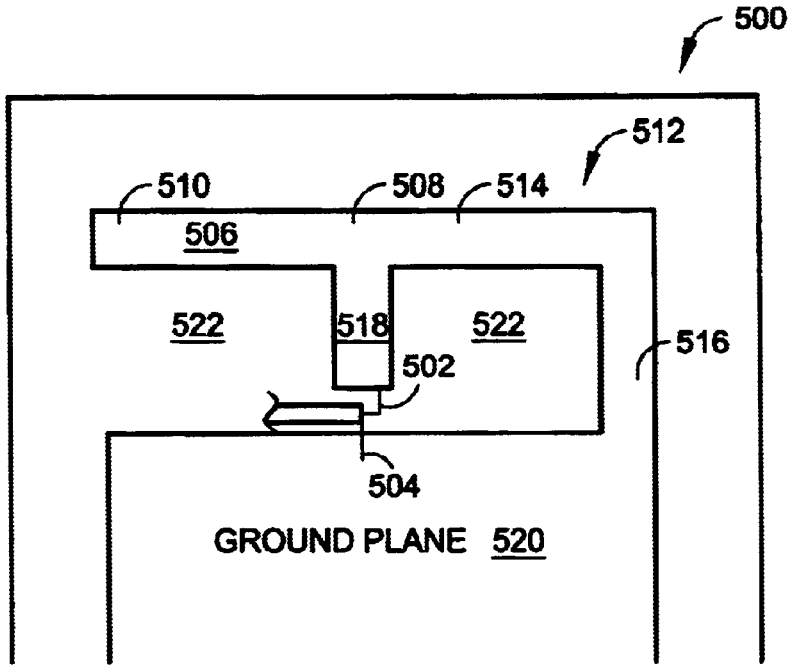
FIGS. 5*a* and 5*b* are plan views of the present invention coplanar inverted-F antenna (CPIFA).
Figure 5B:
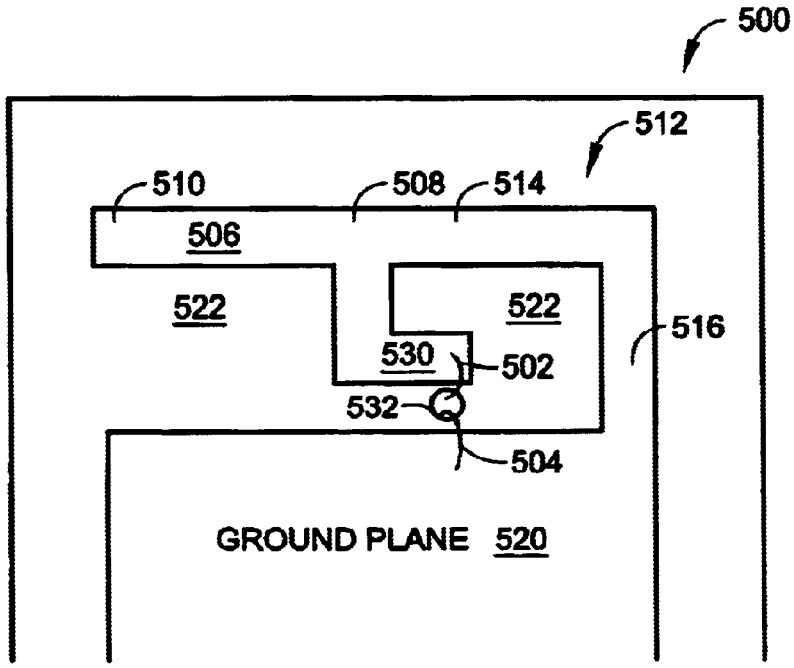

FIGS. 5*a* and 5*b* are plan views of the present invention coplanar inverted-F antenna (CPIFA). As shown in FIG. 5*a*, the CPIFA 500 comprises a signal interface 502 and a ground interface 504. An open radiator 506 is oriented in a first plane having a first end 508 and a second, unterminated end 510. The first plane is the same plane as the sheet of paper on which the figure is drawn. A shorted "L" shaped radiator 512 is oriented in the first plane having a first end 514, connected to the open radiator first end 508, and a second, terminated end 516. A feed 518 is oriented in the first plane and connected between the signal interface 502, and the open radiator first end 508 and the shorted radiator first end 514. Likewise, a groundplane 520 is oriented in the first plane. The shorted radiator 512 is terminated in the groundplane 520. In some aspects, it can be said that both the ground interface 504 and the shorted radiator end 516 are both terminated in a common groundplane 520

The open radiator 506, shorted radiator 512, and feed 518 are formed as conductive layers overlying a dielectric 522. For example, the radiators 506/512 and feed 518 can be copper overlying an FR-4 dielectric. In one aspect, the antenna 500 radiates at a frequency in the range of 1565 to 1585 megahertz.

In some aspects, as shown in FIG. 5*b*, the CPIFA includes a coupled-feed. Then, the CPIFA resembles the antenna of FIG. 2. As shown, the feed 518 is an "L" shaped coupled-feed with a first section 530 oriented parallel to the open radiator 506. Depending on the spacing, section 530 may couple with the radiators 506/512 and/or the groundplane 520. In other aspects (as shown), the CPIFA signal interface and ground interface may be a coaxial type connector 532, with a diameter coming "through" the sheet towards the reader. The signal interface 502 is a coaxial type connector inner signal conductor and the ground interface 504 is the coaxial connector outer ground conductor. The coupled-feed 518 is connected to the coaxial connector inner signal conductor 502 and the shorted radiator second end 516 is connected to the coaxial connector outer ground conductor through a common groundplane 520.

Figure 6:
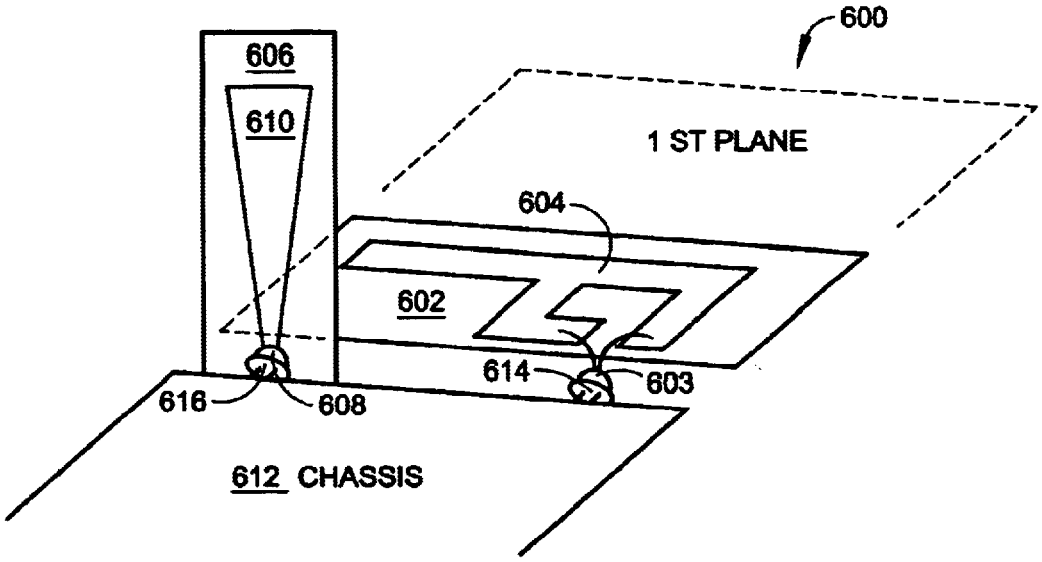
FIG. 6 is a perspective drawing of the present invention wireless telephone tri-band antenna system.

FIG. 6 is a perspective drawing of the present invention wireless telephone tri-band antenna system. The system 600 comprises a coupled-feed inverted-F antenna 602, as described in detail above, with a transmission line port 603 and a radiator 604. The radiator 604 includes both the open and shorted radiators of FIG. 2. The radiator 604 is oriented in a first plane for propagating a first wireless telephone frequency band.

The system 600 also comprises a second antenna 606 with a transmission line port 608 and a radiator 610 oriented in a second plane, orthogonal to the first plane. The second antenna 606 propagates second and third wireless telephone frequency bands. The second antenna is depicted as a planar tapered antenna. However, the system is not necessarily limited to just the tapered design or to just a planar design.

A transceiver module including a chassis 612 is oriented in the first plane, with a first antenna port 614 to interface with the coupled-feed invented-F antenna 602, and a second antenna port 616 to interface with the second antenna 606. The transceiver module chassis 612 is the groundplane for the coupled-feed inverted-F 602 and second 606 antennas. As shown, the chassis 612 is a coplanar groundplane for the coupled-feed inverted-F antenna 602 and an orthogonal groundplane for the second antenna 606. However, other ground-to-radiator orientations are possible. Note that although a coplanar coupled-feed inverted-F antenna has been depicted, the system 600 could also be enable with a planar coupled-feed antenna, such as the antenna described in the explanation of FIG. 5.

In some aspects, the coupled-feed inverted-F antenna 602 propagates at a first frequency band in the range of 1565 to 1585 megahertz (MHz). The second antenna 606 propagates at a second frequency band in the range of 1850 to 1990 MHz and a third frequency band in the range of 824 to 894 MHz.

Figure 7:
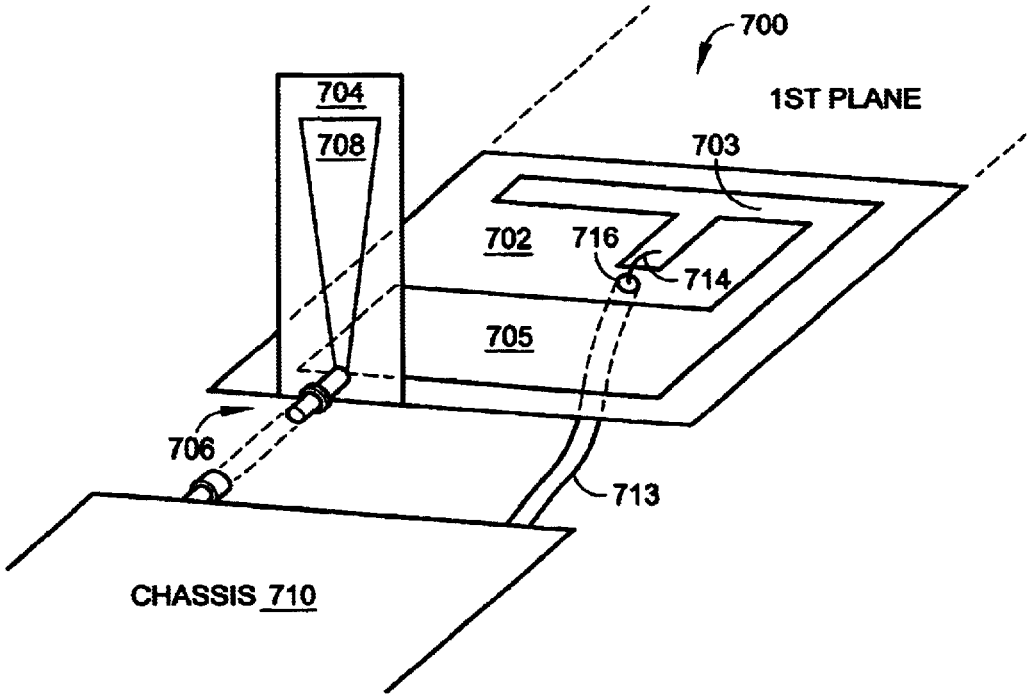
FIG. 7 is another variation of the wireless telephone tri-band antenna system.

FIG. 7 is another variation of the wireless telephone tri-band antenna system. The system 700 comprises a coplanar inverted-F antenna 702 with a radiator 703 and a groundplane 705 oriented in a first plane for propagating a first wireless telephone frequency band. A second antenna 704 with a transmission line port 706 and a radiator 708 are oriented in a second plane, orthogonal to the first plane, for propagating second and third wireless telephone frequency bands. The coplanar inverted-F antenna groundplane 705 acts as the groundplane for the second antenna 704.

In some aspects, a transceiver module including a chassis 710 with an antenna port 712, is interfaced with the second antenna 704. As shown, a coaxial transmission line cable 713 is shown bringing the signal interface 714 and ground interface 716 to the coplanar invented-F antenna 702. The other end of transmission line may be connected to the transceiver module 710, or to some other module (not shown). Note that since the transceiver module chassis 710 is not being used as the groundplane for either the coplanar inverted-F or second antenna, it need not be oriented in any particular plane.

In some aspects, the coplanar inverted-F antenna 702 propagates at a first frequency band in the range of 1565 to 1585 megahertz (MHz). In other aspects, the second antenna 704 is a tapered planar antenna that propagates at a second frequency band in the range of 1850 to 1990 MHz and a third frequency band in the range of 824 to 894 MHz.

A coupled-feed inverted-F antenna, a coplanar inverted-F antenna, and systems using the above-mentioned antennas have been described. As few examples have been given to illustrate and clarify some fundamental concepts. However, the invention is not limited to merely these examples. Other variations and embodiments of the invention will occur to those skilled in the art.

I claim:

1. A coupled-feed inverted-F antenna comprising:

a transmission line port including a signal interface and a ground interface;

an open radiator having a first end and a second, unterminated end;

a shorted "L" shaped radiator having a first end, connected to the open radiator first end, and a second, terminated end; and, a coupled-feed connected between the transmission line port signal interface, and the open radiator first end and the shorted radiator first end.

2. The antenna of claim 1 further comprising:

a groundplane; and, wherein the shorted radiator is terminated in the transmission line port ground interface.

3. The antenna of claim 2 wherein the coupled-feed includes a first section oriented parallel to the open radiator.

4. The antenna of claim 3 wherein the coupled-feed has an "L" shape.

5. The antenna of claim 3 wherein the open radiator is formed as a conductive layer in a first plane overlying a dielectric;

wherein the shorted radiator is formed as a conductive layer in the first plane overlying the dielectric; and, wherein the coupled-feed is formed as a conductive layer in the first plane overlying the dielectric.

6. The antenna of claim 5 wherein the groundplane is formed in the first plane.

7. The antenna of claim 6 wherein the transmission line port is a coaxial type connector including an inner signal conductor and an outer ground conductor;

wherein the coupled-feed first section is connected to the coaxial connector inner signal conductor; and, wherein the shorted radiator second end is connected to the coaxial connector outer ground conductor.

8. The antenna of claim 7 wherein the groundplane is a transceiver module chassis oriented in the first plane and having an antenna port connected to the transmission line port.

9. The antenna of claim 7 wherein the open radiator has a length of approximately 27 millimeters (mm), or less, and a width of 1 mm, or less, overlying an FR4 dielectric having a thickness of 0.81 mm;

wherein the shorted radiator has a first section connected to the open radiator section first end with a length of approximately 10 mm, or less, and a width of 1 mm, or less, and a second section perpendicular to the first section having a length of 8 mm, or less, and a width of 1 mm, or less; and, wherein the coupled-feed has an "L" shape with the first section having a length of 8 mm, or less, and a width of 1 mm, or less, and wherein the coupled-feed has a second section perpendicular to the first section, interposed between the first section and the first ends of the open and shorted radiators, with a length of 7 mm, or less, and a width of 1 mm, or less.

10. The antenna of claim 9 wherein the antenna radiates at a frequency in the range of 1565 to 1585 megahertz.

11. The antenna of claim 3 wherein the open radiator is a conductor formed in a first plane;

wherein the shorted radiator includes a first section conductor formed in the first plane and a second section conductor formed in a second plane perpendicular to the first plane;

wherein the coupled-feed includes a first section conductor formed in a third plane underlying and parallel to the first plane, and a second section conductor formed in a fourth plane parallel to the second plane, interposed between the coupled-feed first section and the open and shorted radiator first ends; and, wherein the groundplane is formed in a fifth plane underlying and parallel to the third plane.

12. A wireless telephone tri-band antenna system, the system comprising:

a coupled-feed inverted-F antenna with a transmission line port and a radiator oriented in a first plane for propagating a first wireless telephone frequency band; and, a second antenna with a transmission line port and a radiator oriented in a second plane, orthogonal to the first plane, for propagating second and third wireless telephone frequency bands.

13. The system of claim 12 further comprising:

a transceiver module including a chassis oriented in the first plane, a first antenna port to interface with the coupled-feed invented-F antenna, and a second antenna port to interface with the second antenna; and, wherein the transceiver module chassis is the groundplane for the coupled-feed inverted-F and second antennas.

14. The system of claim 13 wherein the coupled-feed inverted-F antenna propagates at a first frequency band in the range of 1565 to 1585 megahertz (MHz); and, wherein the second antenna is a tapered planar antenna that propagates at a second frequency band in the range of 1850 to 1990 MHz and a third frequency band in the range of 824 to 894 MHz.

15. A wireless telephone tri-band antenna system, the system comprising:

a coplanar inverted-F antenna with a radiator and groundplane oriented in a first plane for propagating a first wireless telephone frequency band; and, a second antenna with a transmission line port and a radiator oriented in a second plane, orthogonal to the first plane, for propagating second and third wireless telephone frequency bands.

16. The system of claim 15 wherein the coplanar inverted-F antenna groundplane is the groundplane for the second antenna.

17. The system of claim 16 wherein the coplanar inverted-F antenna propagates at a first frequency band in the range of 1565 to 1585 megahertz (MHz); and, wherein the second antenna is a tapered planar antenna that propagates at a second frequency band in the range of 1850 to 1990 MHz and a third frequency band in the range of 824 to 894 MHz.

18. A coplanar inverted-F antenna comprising:

a signal interface and a ground interface;

an open radiator oriented in a first plane having a first end and a second, unterminated end;

a shorted "L" shaped radiator oriented in the first plane having a first end, connected to the open radiator first end, and a second, terminated end;

a feed oriented in the first plane and connected between the signal interface, and the open radiator first end and the shorted radiator first end; and, a groundplane oriented in the first plane.

19. The antenna of claim 18 wherein the shorted radiator is terminated in the ground interface.

20. The antenna of claim 19 wherein the open radiator is formed as a conductive layer overlying a dielectric;

wherein the shorted radiator is formed as a conductive layer overlying the dielectric; and, wherein the feed is formed as a conductive layer overlying the dielectric.

21. The antenna of claim 20 wherein the feed includes a first section oriented parallel to the open radiator.

22. The antenna of claim 21 wherein the signal interface is a coaxial type connector inner signal conductor and wherein the ground interface is the coaxial connector outer ground conductor;

wherein the feed is connected to the coaxial connector inner signal conductor; and, wherein the shorted radiator second end is connected to the coaxial connector outer ground conductor.

23. The antenna of claim 22 wherein the groundplane is a transceiver module chassis oriented in the first plane and having an antenna port connected to the transmission line port.

24. The antenna of claim 21 wherein the feed has an "L" shape.

25. The antenna of claim 20 wherein the antenna radiates at a frequency in the range of 1565 to 1585 megahertz.

* * * * *

UNITED STATES PATENT AND TRADEMARK OFFICE

CERTIFICATE OF CORRECTION

PATENT NO. : 6,894,647 B2
APPLICATION NO. : 10/445107
DATED : May 17, 2005
INVENTOR(S) : Jay Jenwatanavet It is certified that error appears in the above-identified patent and that said Letters Patent is hereby corrected as shown below:

On the title page, delete "Related U.S. Application Data" and delete Item (63) "Continuation-in-part of application No. 10/120,603, files on Apr. 9, 2002, now abandoned."

Signed and Sealed this

Seventeenth Day of October, 2006

JON W. DUDAS
*Director of the United States Patent and Trademark Office*